US007204121B2

(12) United States Patent
Ghezzi

(10) Patent No.: US 7,204,121 B2
(45) **Date of Patent: *Apr. 17, 2007**

(54) METHOD AND APPARATUS FOR INSERTING BLANKS TO BE THREADED IN AUTOMATIC ROTARY ROLLING MACHINES

(75) Inventor: Enrico Ghezzi, Allesandria (IT)

(73) Assignee: S.M.A.R.T., S.R.L., Tortona (IT)

( * ) Notice: Subject to any disclaimer, the term of this patent is extended or adjusted under 35 U.S.C. 154(b) by 15 days.

This patent is subject to a terminal disclaimer.

(21) Appl. No.: 10/520,324

(22) PCT Filed: Jul. 7, 2003

(86) PCT No.: PCT/EP03/07239

§ 371 (c)(1),
(2), (4) Date: Apr. 14, 2005

(87) PCT Pub. No.: WO2004/007110

PCT Pub. Date: Jan. 22, 2004

(65) Prior Publication Data

US 2005/0247093 A1 Nov. 10, 2005

(30) Foreign Application Priority Data

Jul. 17, 2002 (IT) ..... MI2002A1573

(51) Int. Cl.
*B21D 43/02* (2006.01)

(52) U.S. Cl. ..... 72/421; 72/103; 72/425; 72/428; 470/176

(58) Field of Classification Search ..... 72/91, 72/92, 93, 102, 103, 104, 419, 420, 421, 72/422, 425, 428; 470/10, 66, 164, 176, 470/177

See application file for complete search history.

(56) References Cited

U.S. PATENT DOCUMENTS

| | | | | |
|---|---|---|---|---|
| 3,123,251 A | | 3/1964 | Schneider | |
| 3,733,867 A | | 5/1973 | Prutton | |
| 4,195,508 A | * | 4/1980 | Matej | 72/93 |
| 4,546,630 A | * | 10/1985 | Sakamura | 72/68 |
| 4,684,309 A | | 8/1987 | Horn et al. | |
| 5,193,966 A | | 3/1993 | Jung | |
| 5,336,288 A | | 8/1994 | Carlomango et al. | |
| 5,339,669 A | * | 8/1994 | Cretin et al. | 72/108 |
| 6,237,747 B1 | | 5/2001 | Ganter et al. | |
| 6,463,781 B2 | * | 10/2002 | Watanabe et al. | 72/424 |
| 2006/0054631 A1 | * | 3/2006 | Ghezzi | 221/258 |

FOREIGN PATENT DOCUMENTS

| | | |
|---|---|---|
| DE | 19 35 451 A | 1/1971 |
| GB | 8821259 | 11/1961 |
| JP | 10 305337 | 2/1999 |
| JP | 2001-025834 | 5/2001 |
| JP | 2001-185564 | 5/2001 |

* cited by examiner

*Primary Examiner*—Ed Tolan
(74) *Attorney, Agent, or Firm*—R. Neil Sudol; Henry D. Coleman; William J. Sapone

(57) ABSTRACT

A method for inserting blanks to be threaded in automatic rotary rolling machines, in which the step for inserting parts to be machined in the working position occurs at an adjustable, optimized rate, so that the portions of the outer surface of the roller tool affected by contact with the parts that have been inserted vary continuously at each turn of the spindle. This provides a significant reduction in surface wear of the roller, extending its useful life. The invention also relates to an automatic rotary rolling machine.

2 Claims, No Drawings

METHOD AND APPARATUS FOR INSERTING BLANKS TO BE THREADED IN AUTOMATIC ROTARY ROLLING MACHINES

BACKGROUND OF THE INVENTION

The present invention relates to a method and to an apparatus for inserting blanks to be threaded in automatic rotary rolling machines.

Rolling machines for forming screws are known in which the thread is generated by cold rolling.

Among these, rotary rolling machines, in which the blank to be machined is rolled by virtue of a system of threaded rollers, are widely used.

In particular, one type of rolling machine is the roller and sector rotary type, in which there is a single roller tool and the part is rolled under pressure between the tool and a semicircular guide.

These kinds of machine usually include an automatic device for inserting the parts in the working position, which is actuated by a kinematic system, generally of the cam type, connected to the tool supporting spindle.

Usually, the tool supporting roller has a number of thread starts that varies between 10 and 60, depending on its diameter and on the diameter of the screw to be formed.

The cam of the kinematic system connected to the spindle must be sized so that the insertion of a part occurs at one of the starts of the roller tool.

Accordingly, the number of parts inserted at each turn of the spindle is a submultiple of the number of starts of the roller.

This entails that with this kind of insertion device, which is automated in a rigid manner, at each turn the parts are always inserted at the same starts of the roller, causing increased wear of the corresponding portions of the outer surface of the roller.

The consequence of this is an uneven wear of the threaded outer surface of the roller, which entails a reduction in the life of the tool.

U.S. Pat. No. 3733867 discloses a thread rolling machine provided with a rotary die having multiple starts of a thread form and workpieces are fed in synchronism so that the starting points of threads on successive workpieces gradually moves around the periphery of the die.

An aim of the present invention is to provide a method and an apparatus for inserting blanks to be threaded in automatic rotary rolling machines that overcome the drawbacks of the cited prior art.

OBJECTS OF THE INVENTION

An object of the invention is to provide a method and an apparatus that allow perfectly uniform wear of the machining surface of the tool.

A further object of the invention is to provide a method and an apparatus that ensure a significant increase in the life of the tool.

A further object of the invention is to provide a method and an apparatus that allow to adjust more flexibly the number of parts inserted at each turn of the spindle.

A further object is to provide a method and an apparatus wherein the steps for the insertion of the part in the working position are simplified.

A further object of the invention is to provide a method and an apparatus that allow to obtain finished products of higher quality than conventional methods.

This aim and these and other objects that will become better apparent hereinafter are achieved by a method for inserting blanks to be threaded in automatic rotary rolling machines, as claimed in the appended claims.

This aim and these and other objects that will become better apparent hereinafter are also achieved by an apparatus as claimed in the appended claims.

Further characteristics and advantages will become better apparent from the description of preferred but not exclusive embodiments of the invention.

DETAILED DESCRIPTION OF PREFERRED EMBODIMENTS

The method for inserting blanks to be threaded in automatic rotary rolling machines can be applied to an automatic rotary rolling machine of the roller and sector type.

The machine includes a roller tool and a semicircular fixed guide, commonly termed sector, on which the part to be threaded is made to roll under pressure during rolling.

The blanks to be machined arrive from a feeder guide and are arranged in contact with the roller in a working position, preferably by virtue of an automated insertion device.

The insertion device inserts the parts in the working position, applying the insertion method according to the invention.

The insertion step consists in inserting in the working position a certain number of parts at each turn of the spindle on which the roller tool is mounted, so that they are machined by rolling.

The part pressed against the outer threaded surface of the roller undergoes a permanent plastic deformation that forces it to assume the shape of the thread.

As soon as the part is inserted in the working position and begins to be machined, it makes contact with the roller at a portion of the outer surface of the roller together with an inner portion of the sector.

The next part that is inserted makes contact with the roller at a subsequent portion of its outer surface that is arranged at a certain angular distance from the first portion.

The particularity of the method according to the invention is that the part insertion step occurs at a rate that is optimized and adjustable, so that the portions of the surface of the roller that are successively in contact, in the working position, with the parts inserted in a full turn of the spindle do not coincide with the portions engaged in the following turn.

Part insertion is adjusted by using an apparatus that is constituted by a base body that is rigidly coupled to the frame of the machine and is adapted to support a reciprocating member that is actuated for example by a linear motor.

The reciprocating member has a transverse guide, to which an insertion punch or pusher is applied; its position on the transverse guide is adjustable and is set for example by means of a screw system.

The linear motor is controlled electronically and the system therefore allows fully automatic adjustment.

It should be noted that each one of the portions of the outer surface of the roller that engages in each instance the parts during the insertion step corresponds to one of the starts of the outer thread of the roller.

With the described method, therefore, the starts of the thread of the roller that make contact with the parts upon insertion in a full turn of the spindle differ from the ones in contact in the next turn.

In practice it has been found that the invention achieves the intended aim and objects, a method having been provided for inserting blanks to be threaded in automatic rotary rolling machines that allows to improve the functionality of this kind of machine.

It is in fact evident that the described method allows to provide uniform tool wear, extending its life accordingly.

Another advantage of the described method arises from a greater size constancy of the threads of the screws, with a consequent improvement in the quality of the product.

The method and the apparatus according to the invention are susceptible of numerous modifications and variations, within the scope of the appended claims. All the details may be replaced with technically equivalent elements.

The materials used, as well as the dimensions, may of course be any according to requirements and to the state of the art.

What is claimed is:

1. A method of inserting blanks to be threaded in an automatic rotary rolling machine, said automatic rotary rolling machine comprising at least one roller tool, at least one guide for feeding the parts to be machined, and an insertion device for picking the parts from said guide and inserting them in an active position, said insertion device comprising a reciprocating member provided with a means for picking a part to be machined from a guide and for inserting it in a working position, said reciprocating member inserting each part at such a rate that the portions of the outer surface of the roller tool that engage the parts inserted in the working position are changed continuously at each turn of a spindle, said reciprocating member being actuated by an electronically controlled linear motor.

2. A method of inserting blanks to be threaded in an automatic rotary rolling machine comprising at least one roller tool, the method comprising:

feeding the parts to be machined along at least one guide; and operating an insertion device to pick the parts from said guide and insert the parts in an active position, the operating of said insertion device including reciprocating a member provided with a means for picking a part to be machined from said guide and for inserting the picked part in a working position, the operating of said insertion device further including reciprocating said member to insert each part at such a rate that the portions of an outer surface of the roller tool that engage the parts inserted in the working position are changed continuously at each turn of a spindle, the operating of said insertion device additionally including operating an electronically controlled linear motor to reciprocate said member.

* * * * *